US010622748B2

(12) United States Patent
Jin et al.

(10) Patent No.: US 10,622,748 B2
(45) Date of Patent: Apr. 14, 2020

(54) TERMINAL AND CONNECTOR

(71) Applicant: Yazaki Corporation, Tokyo (JP)

(72) Inventors: Dacheng Jin, Shizuoka (JP); Naokazu Nagasaka, Shizuoka (JP); Atsuhito Saito, Shizuoka (JP); Shingo Chiba, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/431,464

(22) Filed: Jun. 4, 2019

(65) Prior Publication Data

US 2019/0379149 A1 Dec. 12, 2019

(30) Foreign Application Priority Data

Jun. 7, 2018 (JP) ..... 2018-109341

(51) Int. Cl.

| | |
|---|---|
| ***H01R 13/40*** | (2006.01) |
| ***H01R 13/436*** | (2006.01) |
| ***H01R 4/18*** | (2006.01) |
| ***H01R 13/04*** | (2006.01) |
| ***H01R 13/424*** | (2006.01) |

(52) U.S. Cl.

CPC ..... *H01R 13/4368* (2013.01); *H01R 4/185* (2013.01); *H01R 13/04* (2013.01); *H01R 13/424* (2013.01)

(58) Field of Classification Search

CPC ..... H01R 13/4361
USPC ..... 595/595, 752
See application file for complete search history.

(56) References Cited

U.S. PATENT DOCUMENTS

| | | | | |
|---|---|---|---|---|
| 4,946,399 | A * | 8/1990 | Kawashima | H01R 13/436 439/752 |
| 5,160,283 | A * | 11/1992 | Fry | H01R 13/4362 439/752 |
| 5,460,550 | A * | 10/1995 | Okayasu | H01R 13/4362 439/752 |
| 6,755,696 | B1 | 6/2004 | Ko | |
| 8,784,141 | B2 * | 7/2014 | Ishikawa | H01R 43/20 439/595 |
| 9,608,355 | B2 * | 3/2017 | Nagai | H01R 13/4223 |
| 2002/0034897 | A1 | 3/2002 | Suzuki | |
| 2015/0364857 | A1 | 12/2015 | Endo et al. | |
| 2017/0170593 | A1 | 6/2017 | Uezono | |

FOREIGN PATENT DOCUMENTS

| | | | |
|---|---|---|---|
| DE | 10 2015 210 663 | A1 | 12/2015 |
| DE | 10 2016 013 949 | A1 | 6/2017 |
| EP | 2 846 403 | A2 | 3/2015 |
| JP | 2003-243079 | A | 8/2003 |

* cited by examiner

*Primary Examiner* — Neil Abrams
(74) *Attorney, Agent, or Firm* — Kenealy Vaidya LLP

(57) ABSTRACT

A terminal includes a box, the box of the terminal connected to an electric wire includes a ceiling plate and an inner plate. The ceiling plate includes a front ceiling plate and a rear ceiling plate formed by a notch. The rear ceiling plate includes a projection part engagement surface provided by the forming of the notch. The inner plate includes a projection part. In a state where the ceiling plate and the inner plate are superimposed, the projection part and the projection part engagement surface are engaged with each other.

3 Claims, 7 Drawing Sheets

TERMINAL AND CONNECTOR

CROSS-REFERENCE TO RELATED APPLICATION(S)

The present application claims priority to and incorporates by reference the entire contents of Japanese Patent Application No. 2018-109341 filed in Japan on Jun. 7, 2018.

BACKGROUND OF THE INVENTION

1. Field of the Invention

The present invention relates to a terminal housed in a connector and the connector.

2. Description of the Related Art

Conventionally, there has been known a connector in which, while a retainer is preliminarily held at a temporary locking position of a housing, a terminal connected to an electric wire is inserted into a cavity (terminal housing chamber) and a bending and deforming lance provided to a bottom wall of the cavity and a locked unit of the terminal are engaged with each other, and after that, the retainer is pushed (inserted) from the temporary locking position to a final locking position so as to engage a retaining unit of the retainer with a jaw unit (retainer locking unit) of the terminal (for example, Japanese Patent Application Laid-open No. 2003-243079).

In a connector disclosed in Japanese Patent Application Laid-open No. 2003-243079, a connection part of a terminal includes a bottom plate, a pair of facing side plates, an inner plate, and a ceiling plate. The ceiling plate has a recessed part formed thereon and includes a part to be engaged projecting so that the part to be engaged is adjacent to the recessed part. The recessed part weakens strength of the ceiling plate in the terminal. In the middle of handling the terminal connected to an electric wire, if a tensile force is applied to the electric wire in a state where a jaw unit of the terminal is caught in the periphery, the terminal might be deformed with a rear side of the ceiling plate as a starting point.

SUMMARY OF THE INVENTION

In view of the foregoing, an object of the present invention is to provide a terminal capable of improving terminal strength.

In order to solve the above mentioned problem and achieve the object, a terminal according to one aspect of the present invention includes an electric wire; and a terminal being connected to the electric wire, the terminal including a box, and an electric wire connecting unit, wherein a cross section of the box in a direction perpendicular to a front-rear direction has a rectangular shape, the box includes a bottom plate, a first side plate, a second side plate, an inner plate, and a ceiling plate, the first side plate and the second side plate face each other in a width direction, the bottom plate and the inner plate face each other in a height direction, the ceiling plate is superimposed on the inner plate on a side of the inner plate opposite to a side thereof facing the bottom plate, has a notch formed at the midpoint in the front-rear direction, and includes a front ceiling plate on a front direction side and a rear ceiling plate on a rear direction side, the front ceiling plate includes a first locked unit on the rear direction side, the rear ceiling plate includes a projection part engagement surface on the front direction side and a second locked unit on the rear direction side, the inner plate includes a projection part that projects on the ceiling plate side, and the projection part is engaged with the projection part engagement surface in the front-rear direction.

In order to achieve the object, a connector according to another aspect of the present invention includes the terminal; a housing; and a retainer, wherein the housing includes a housing body, the housing body has a terminal housing chamber formed therein, the terminal housing chamber passing through the housing body in a front-rear direction, the housing body has an aperture on a rear direction side of the terminal housing chamber, a cross section of the terminal housing chamber in a direction perpendicular to the front-rear direction has a rectangular shape, the housing body includes a lance that is elastically deformable, the lance including a first locking unit projecting in the terminal housing chamber, a body lower surface that is a surface of the housing body on a downward direction side, a retainer insertion space that is, in the front-rear direction, disposed on the rear direction side of the lance so as to separate the terminal housing chamber, and an insertion space aperture that is formed on the downward direction side of the retainer insertion space, the terminal is inserted from the aperture of the housing body on the rear direction side into the terminal housing chamber, the retainer is inserted into the retainer insertion space from the insertion space aperture of the housing body on the downward direction side toward an upward direction, the retainer includes a projection strip unit, a second locking unit, and a retainer lower surface that is a surface of the retainer on the downward direction side, the projection strip unit projects on the upward direction side and has a dimension that allows the projection strip unit to enter the notch when seen in a height direction, and in a mid-insertion state where the terminal is middle of being inserted into the terminal housing chamber, when the retainer is inserted into the retainer insertion space toward the upward direction, the projection strip unit abuts on the projection part, and the retainer lower surface projects in the downward direction by an increased projection amount of the projection part with respect to a predetermined projection amount from the body lower surface of the housing body.

According to still another aspect of the present invention, in the connector, it is preferable that the housing body and the retainer include a temporary locking unit and a final locking unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

An embodiment of a connector according to the present invention will now be described with reference to the accompanying drawings. It should be noted that this embodiment is not intended to limit the invention.

Embodiment

Figure 1:
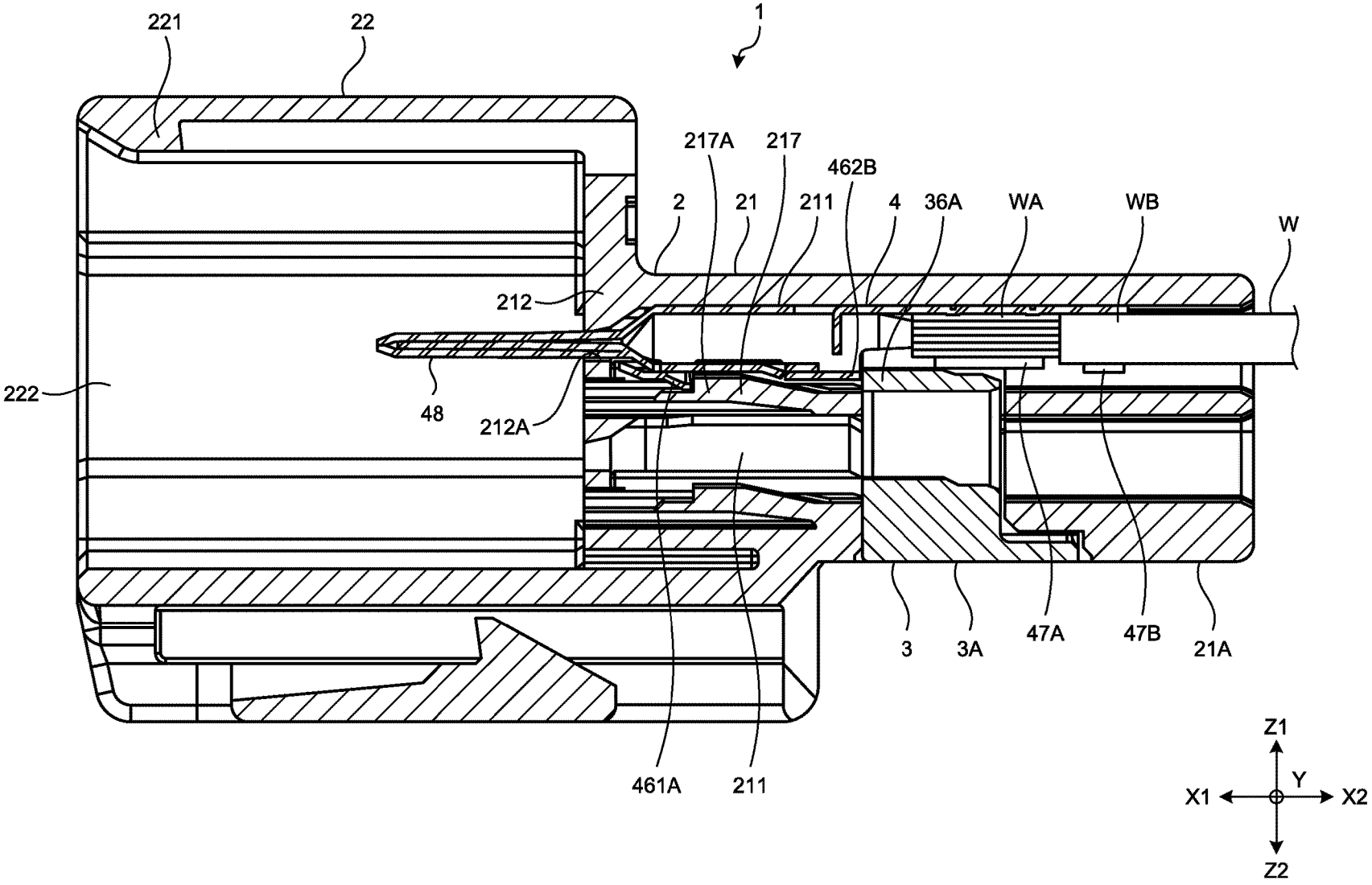
FIG. 1 is a cross-sectional view illustrating a connector related to an embodiment of the present invention.
Figure 2:
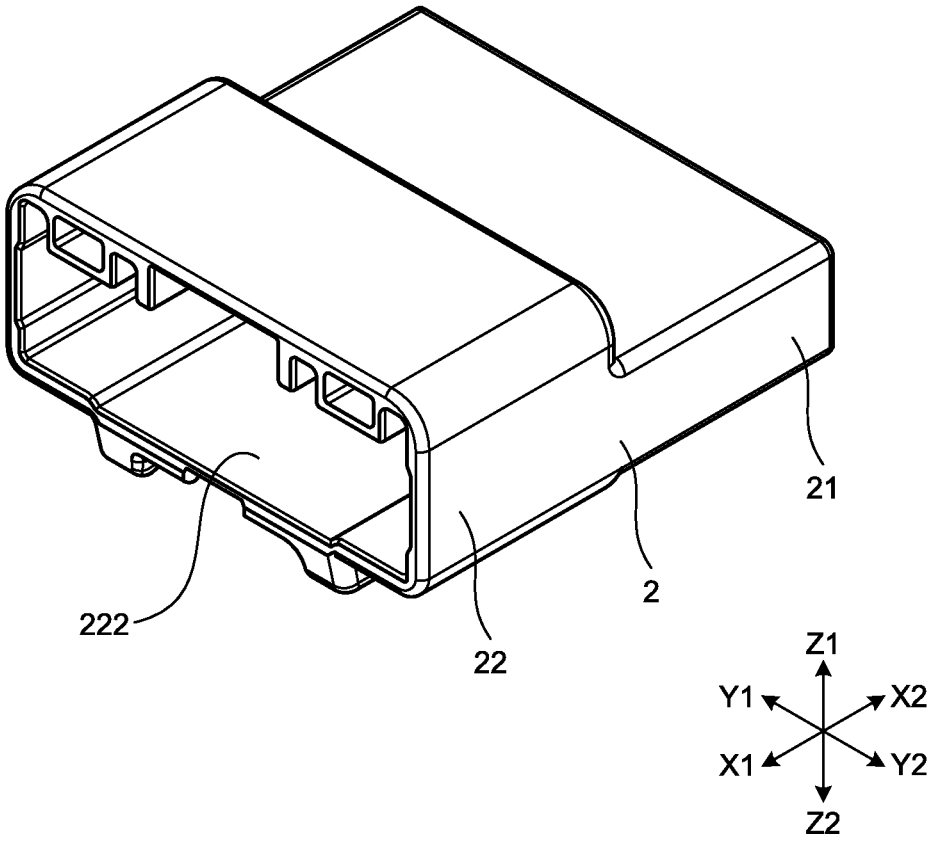
FIG. 2 is a perspective view illustrating a housing.
Figure 3:
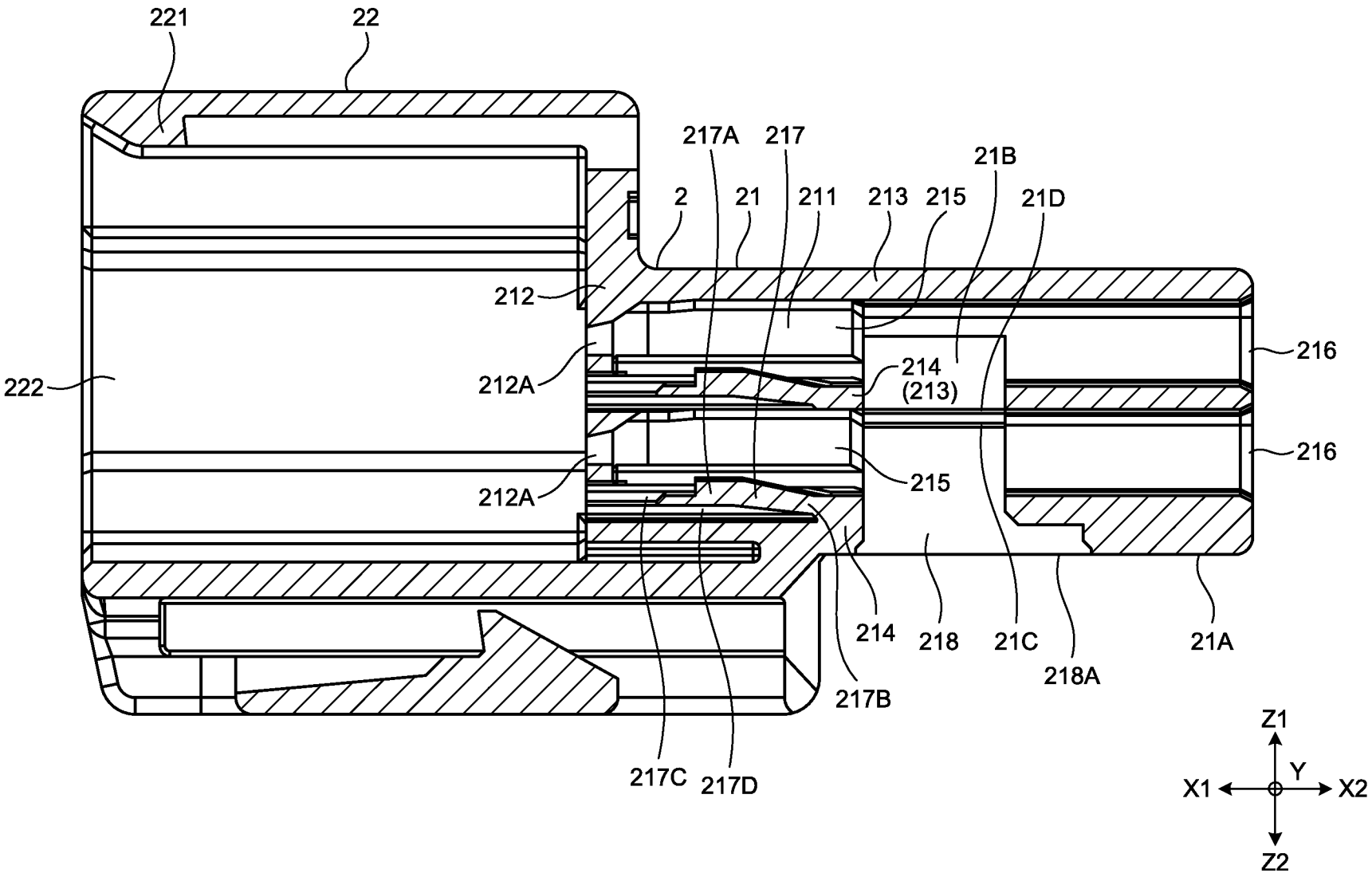
FIG. 3 is a cross-sectional view illustrating the housing.
Figure 4:
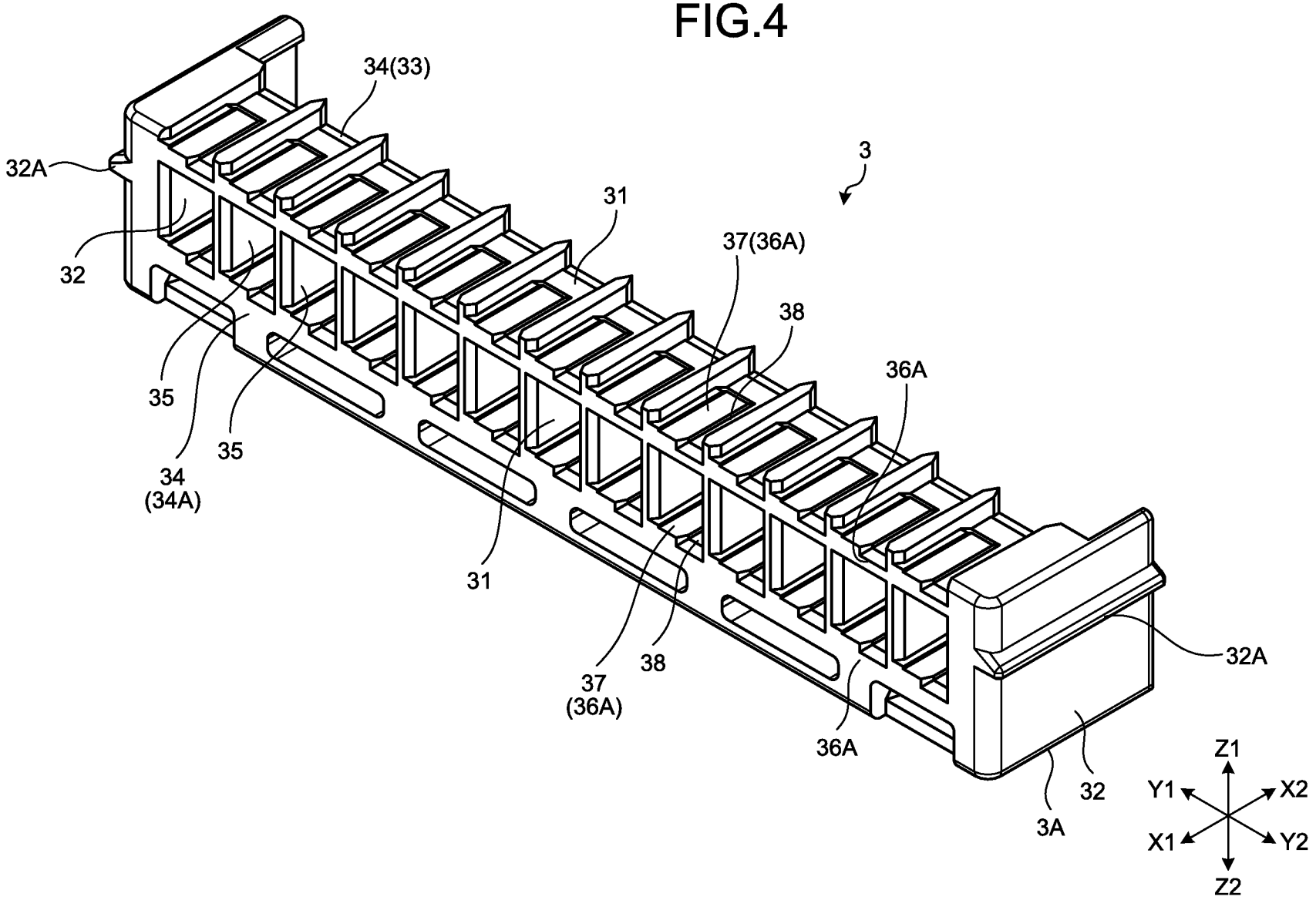
FIG. 4 is a perspective view illustrating a retainer.
Figure 5:
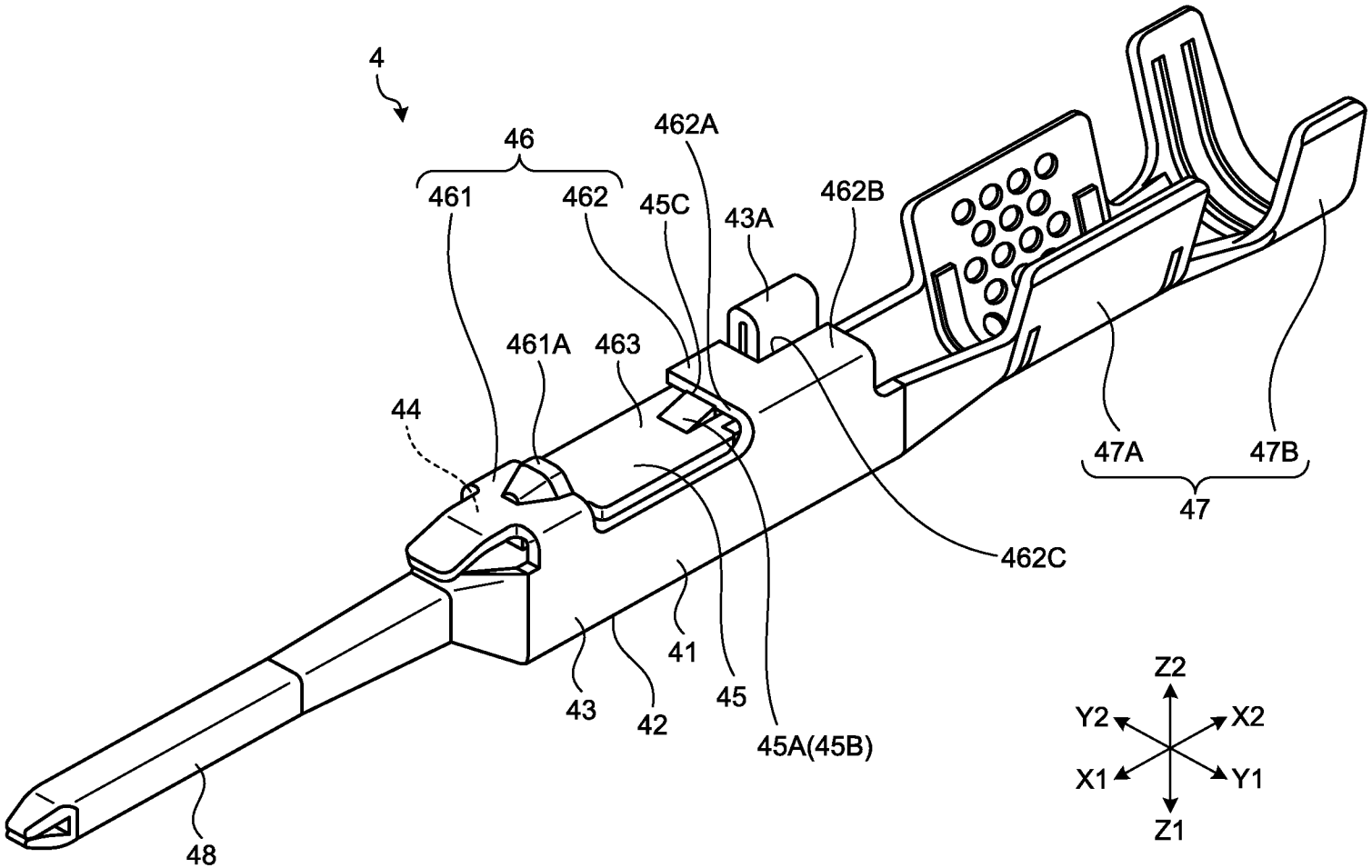
FIG. 5 is a perspective view illustrating a terminal.
Figure 6:
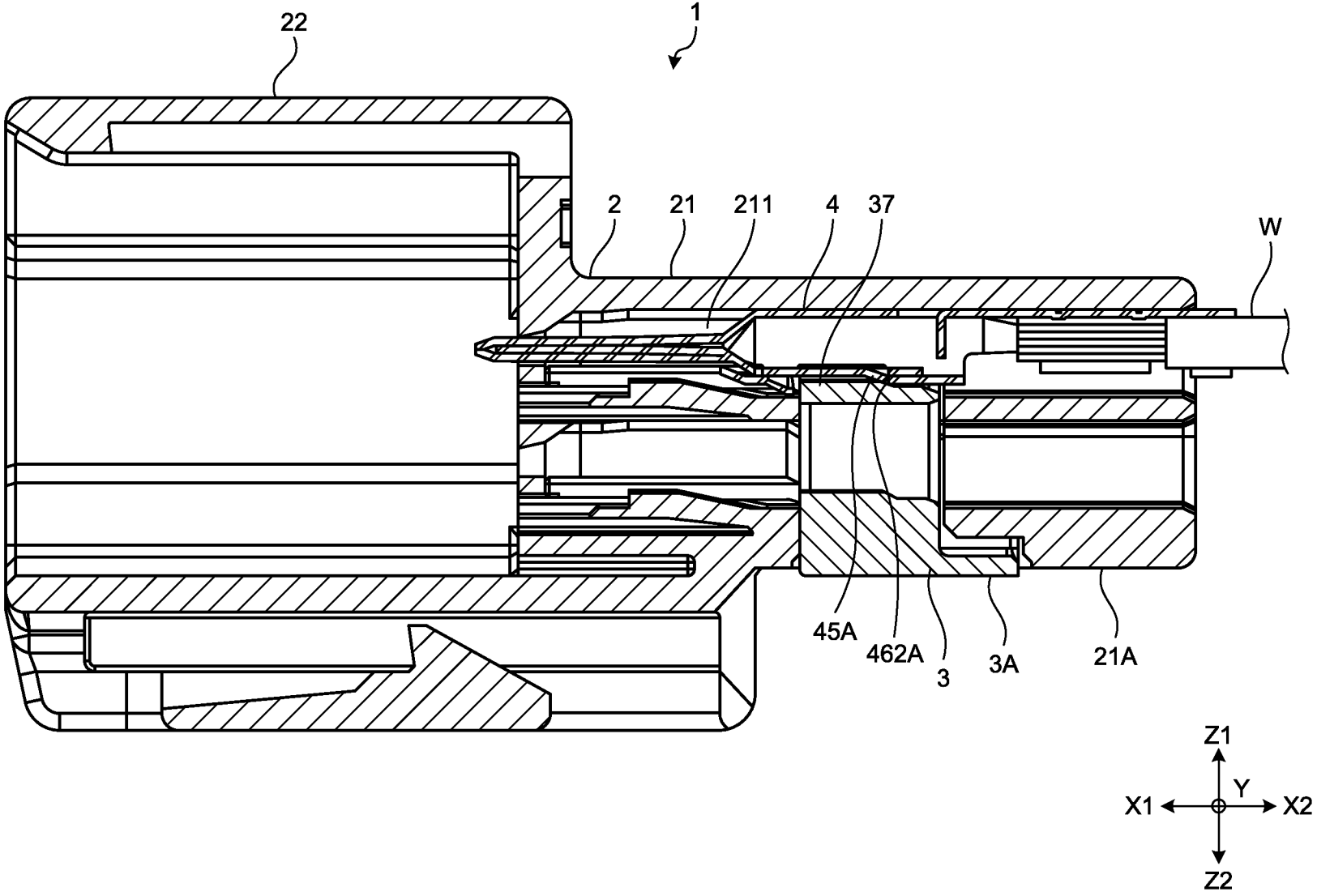
FIG. 6 is a cross-sectional view illustrating the connector that represents a state where the terminal is in the middle of being inserted.
Figure 7:
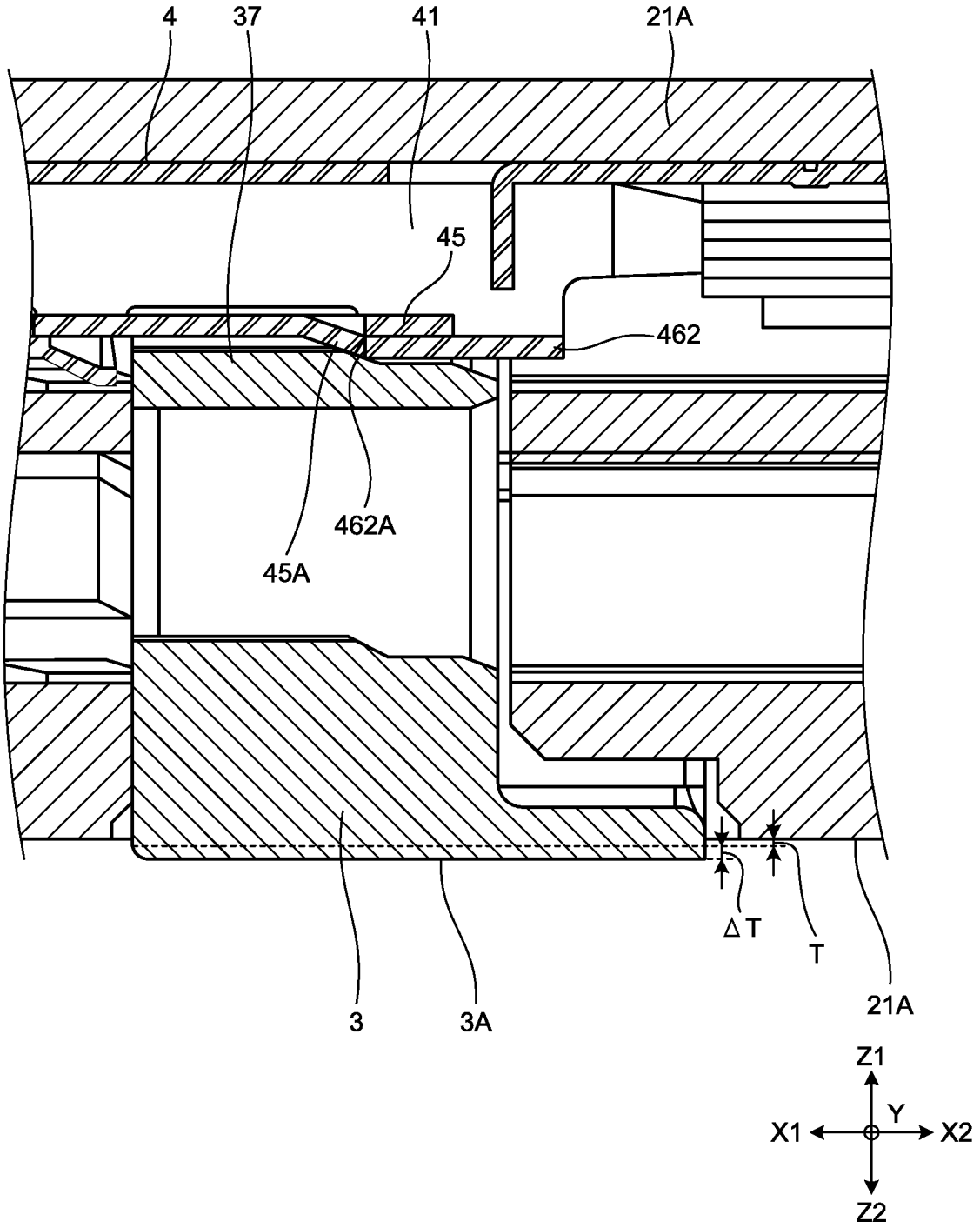
FIG. 7 is a partial cross-sectional view of FIG. 6.

The configuration of a connector according to one embodiment of the present invention will be described with reference to FIGS. 1 to 7. FIG. 1 is a cross-sectional view illustrating a connector 1 related to an embodiment of the present invention. FIG. 2 is a perspective view illustrating a housing 2. FIG. 3 is a cross-sectional view illustrating the housing 2. FIG. 4 is a perspective view illustrating a retainer 3. FIG. 5 is a perspective view illustrating a terminal 4. FIG. 6 is a cross-sectional view illustrating the connector 1 that represents a state where the terminal 4 is in the middle of being inserted. FIG. 7 is a partial cross-sectional view of FIG. 6. FIGS. 1 and 6 illustrate, in two-stage terminal housing chambers 211 in a height direction Z, the terminal 4 connected to an electric wire W only in the terminal housing chamber 211 on an upward direction Z1 side.

In the drawings, X indicates a front-rear direction of the connector 1, and X1 is a front direction and an insertion direction of the terminal 4 to the housing 2 and X2 is a rear direction and a separation direction of the terminal 4 to the housing 2. Y indicates a width direction of the connector 1, and Y1 is a left direction and Y2 is a right direction. Z indicates a height direction, and Z1 is an upward direction and Z2 is a downward direction. X, Y, Z are directions perpendicular to one another.

As illustrated in FIG. 1, the connector 1 includes the housing 2, the terminal 4, and the retainer 3, and the terminal 4 is connected to the electric wire W. The connector 1 in the present embodiment is a male connector that houses the male terminal 4.

As illustrated in FIGS. 2 and 3, the housing 2 includes a hood 22 and a housing body 21, and is formed of an insulating synthetic resin by injection molding with a die. The hood 22 is disposed on the front direction X1 side of the housing 2. The housing body 21 is disposed on the rear direction X2 side of the housing 2.

The cross section of the hood 22 perpendicular to the front-rear direction X has a rectangular cylindrical shape. The hood 22 has a fitting space 222 formed therein, and includes a lock projection 221 projecting in the fitting space 222 on the front direction X1 side. In the fitting space 222 of the hood 22, a counterpart connector, which is not illustrated, is inserted, and the lock projection 221 is engaged with a lock of the counterpart connector so as to fit the counterpart connector to the connector 1.

The cross section of the housing body 21 perpendicular to the front-rear direction X is formed in a rectangular parallelepiped shape. A surface of the housing body 21 on the downward direction Z2 side is a lower surface 21A. In the housing body 21, a plurality of the terminal housing chambers 211 and a retainer insertion space 218 are formed. The housing body 21 has an aperture 216 on the rear direction X2 side of each of the terminal housing chambers 211, and an insertion aperture 218A on the downward direction Z2 side of the retainer insertion space 218. Each of the terminal housing chambers 211 in the present embodiment has the same shape. The housing body 21 includes, in each of the terminal housing chambers 211, a lance 217 that is elastically deformable with respect to the housing body 21, the lance 217 including a first locking unit 217A projecting toward the upward direction Z1 side. In the housing body 21, the retainer insertion space 218 disposed on the rear direction X2 side of the lance is formed. The housing body 21 in the present embodiment has the terminal housing chambers 211 that have two stages in the height direction Z and 13 rows in the width direction Y formed therein.

Each of the terminal housing chambers 211 is a space formed so as to pass through the housing body 21 in the front-rear direction X. The terminal housing chamber 211 is partitioned by a front wall 212 on the front direction X1 side of the housing body 21, an upper wall 213 and a lower wall 214 facing in the height direction Z, and side walls 215 facing in the width direction Y. The cross section of the terminal housing chamber 211 perpendicular to the front-rear direction X has a rectangular parallelepiped shape. As illustrated in FIG. 3, the lower wall 214 of the terminal housing chamber 211 on the upward direction Z1 side also serves as the upper wall 213 of the terminal housing chamber 211 on the downward direction Z2 side. On the front direction X1 side, the terminal housing chamber 211 is each communicated with the fitting space 222 of the hood 22 through a through-hole 212A of the front wall 212. On the rear direction X2 side, the terminal housing chamber 211 is communicated with the outside through the aperture 216.

Each of the lances 217 includes a base 217B, a connection arm 217C, and the first locking unit 217A. The base 217B is disposed on the rear direction X2 side of the lance 217 and is connected to the lower wall 214. The connection arm 217C extends from the front direction X1 side of the first locking unit 217A toward the front direction X1, and is connected to the front wall 212. The first locking unit 217A is disposed between the connection arm 217C and the base 217B. The lance 217 has a shape of a beam with both ends fixed, and is elastically deformable toward a bending space 217D formed on the downward direction Z2 side of the lance 217. When the terminal 4 connected to the electric wire W is inserted into the terminal housing chamber 211 from the aperture 216 of the housing body 21 on the rear direction X2 side, the terminal 4 starts to slide with respect to the lance 217 projecting in the terminal housing chamber 211 and the lance 217 is elastically deformed toward the bending space 217D on the downward direction Z2 side. In a state where the terminal 4 is housed at a predetermined position of the terminal housing chambers 211, in other words, in a state where insertion is completed, the terminal 4 is not sliding with respect to the lance 217, the lance 217 returns from elastic deformation, and the first locking unit 217A of the lance 217 and a first locked unit 461A of the terminal 4, which will be described later, face each other in the front-rear direction X and are engaged with each other (refer to FIG. 1).

As illustrated in FIG. 3, the retainer insertion space 218 is a space formed so that the retainer insertion space 218 is recessed in the upward direction Z1 from the insertion space aperture 218A on the downward direction Z2 side of the housing body 21. The retainer insertion space 218 is, in the width direction Y, partitioned by facing space side walls 21B in the housing body 21, is partitioned by the upper wall 213 on the upward direction Z1 side, and is communicated with the outside through the insertion space aperture 218A on the downward direction Z2 side. The cross section of the retainer insertion space 218 in a direction perpendicular to the front-rear direction X has a rectangular parallelepiped shape. In the front-rear direction X, the retainer insertion space 218 is disposed on the rear direction X2 side of the lance 217 at the midpoint of the housing body 21 so as to separate the terminal housing chambers 211. In the retainer insertion space 218, the retainer 3 is inserted from the insertion space aperture 218A toward the upward direction Z1. Each of the facing space side walls 21B includes, in the width direction Y, a temporary locking projection 21C and a final locking projection 21D that project on the retainer insertion space 218 side.

As illustrated in FIG. 5, the terminal 4 is formed by die-cutting and bending a conductive metal plate made of a metal material such as copper/a copper alloy. The terminal 4 includes a tab 48, a box 41, and an electric wire connecting unit 47. The terminal 4 in the present embodiment is a male terminal that includes the tab 48. After the terminal 4 is connected to the electric wire W, the terminal 4 is inserted into each of the terminal housing chambers 211 in the housing body 21.

The tab 48 is continuously provided to the front direction X1 side of the box 41, and the cross section of the tab 48 in a direction perpendicular to the front-rear direction X has a rectangular parallelepiped shape. In a state where insertion is completed, the tab 48 is inserted into the through-hole 212A and projects in the fitting space 222.

The box 41 includes a bottom plate 42, a first side plate 43, a second side plate 44, an inner plate 45, and a ceiling plate 46. The cross section of the box 41 in a direction perpendicular to the front-rear direction X has a rectangular cylindrical shape. In the box 41, the first side plate 43 and the second side plate 44 face each other in the width direction Y, and the bottom plate 42 and the inner plate 45 face each other in the height direction Z. Out of both ends in the width direction Y, the bottom plate 42 is connected to the first side plate 43 at one end on the left direction Y1 side and is connected to the second side plate 44 at the other end on the right direction Y2 side. The first side plate 43 is connected to the ceiling plate 46 at an end on the upward direction Z1 side. The second side plate 44 is connected to the inner plate 45 at an end on the upward direction Z1 side. The ceiling plate 46 is superimposed on the downward direction Z2 side of the inner plate 45 in the height direction Z. In other words, the ceiling plate 46 is superimposed, in the height direction Z, on the inner plate 45 on a side of the inner plate 45 opposite to a side thereof facing the bottom plate 42. On the rear direction X2 side of the box 41, a stabilizer 43A that extends and is folded back in the downward direction Z2 from the first side plate 43 is provided.

In the front-rear direction X, the ceiling plate 46 has a notch 463 formed at the midpoint. The ceiling plate 46 includes a front ceiling plate 461 on the front direction X1 side and a rear ceiling plate 462 on the rear direction X2 side sandwiching the notch 463. In the width direction Y, the notch 463 is formed from a surface of the first side plate 43 on the left direction Y1 side to a surface of the second side plate 44 on the right direction Y2 side.

The front ceiling plate 461 includes the first locked unit 461A. The first locked unit 461A is disposed on the rear direction X2 side of the front ceiling plate 461, and is formed in substantially a triangular pyramid shape by punching processing. In a state where insertion is completed, the first locked unit 461A is engaged with the first locking unit 217A of the lance 217 (refer to FIG. 1). Specifically, a surface of the first locking unit 217A on the front direction X1 side is engaged with a surface of the rear direction X2 side of the first locked unit 461A having substantially a triangular pyramid shape.

The rear ceiling plate 462 includes a projection part engagement surface 462A on the front direction X1 side, and includes a second locked unit 462B on the rear direction X2 side. The projection part engagement surface 462A is a surface of the rear ceiling plate 462 on the front direction X1 side that is formed by the notch 463 of the ceiling plate 46. The second locked unit 462B is a surface of the rear ceiling plate 462 on the rear direction X2 side.

The inner plate 45 includes a projection part 45A on the ceiling plate 46 side that projects in the downward direction Z2. In the front-rear direction X, the projection part 45A is a plate 45B that is formed by cutting and raising the midpoint of the inner plate 45. The plate 45B on the front direction X1 side is connected to the inner plate 45. The plate 45B on the rear direction X2 side projects on the downward direction Z2 side, is inclined to the downward direction Z2 side from the front direction X1 side to the rear direction X2 side, and includes an edge 45C on the rear direction X2 side.

When the ceiling plate 46 and the inner plate 45 are superimposed by bending the terminal 4, the projection part 45A is engaged with the projection part engagement surface 462A of the rear ceiling plate 462 in the front-rear direction X. Specifically, in the projection part 45A, the edge 45C is engaged with the projection part engagement surface 462A. The case where the projection part 45A in the present embodiment is engaged with the projection part engagement surface 462A includes, in consideration of bending processing of the terminal 4, a case where there is a gap between the edge 45C of the projection part 45A and the projection part engagement surface 462A in the front-rear direction X and a case where there is no gap between them.

The rear ceiling plate 462 includes a rear notch 462C on the rear direction X2 side. In the width direction Y, the rear notch 462C causes the stabilizer 43A to project in the downward direction Z2 within a width dimension of the terminal 4. The rear ceiling plate 462 is disposed so that the rear ceiling plate 462 is sandwiched between the edge 45C of the projection part 45A on the rear direction X2 side and a surface facing the front direction X1 side of the stabilizer 43A.

The electric wire connecting unit 47 is continuously provided to the rear direction X2 side of the box 41, and includes a core wire fastening piece 47A and a covered fastening piece 47B. The electric wire connecting unit 47 has a U-shape in a cross sectional view perpendicular to the front-rear direction X. As illustrated in FIG. 1, in the electric wire connecting unit 47, the core wire fastening piece 47A is fastened to a core wire WA and the covered fastening piece 47B is fastened to a covering WB. In this manner, the electric wire W is connected to the terminal 4. The core wire WA is formed of a metal material such as copper/a copper alloy and aluminum/an aluminum alloy.

As illustrated in FIG. 4, the cross section of the retainer 3 in a direction perpendicular to the front-rear direction X has a rectangular parallelepiped shape, and the retainer 3 is formed of an insulating synthetic resin by injection molding with a die. In the retainer 3, a plurality of terminal insertion holes 31 are formed. The retainer 3 in the present embodiment has the terminal insertion holes 31 that have two stages in the height direction Z and 13 rows in the width direction Y formed therein. Each of the terminal insertion holes 31 has the same shape.

Each of the terminal insertion holes 31 on the downward direction Z2 side is partitioned by an upper plate 33 and a lower plate 34 that face each other in the height direction Z and side plates 35 that face each other in the width direction Y. Each of the terminal insertion holes 31 on the upward direction Z1 side is partitioned by the lower plate 34 on the downward direction Z2 side in the height direction Z and the side plates 35 that face each other in the width direction Y, and the upward direction Z1 side of the terminal insertion holes 31 is not partitioned. The terminal insertion holes 31 disposed at both ends in the width direction Y are partitioned by outer side plates 32 and the side plates 35 that face each other. The lower plate 34 that corresponds to the terminal insertion hole 31 on the upward direction Z1 side also serves as the upper plate 33 of the terminal insertion hole 31 on the downward direction Z2 side. In addition, the lower plate 34 that corresponds to the terminal insertion hole 31 on the downward direction Z2 side also serves as a surface plate 34A. A surface on the downward direction Z2 side of the surface plate 34A is a retainer lower surface 3A.

The outer side plate 32 on the left direction Y1 side includes a locking projection 32A that projects in the left direction Y1, and the outer side plate 32 on the right direction Y2 side includes a locking projection 32A that projects in the right direction Y2.

The retainer 3 is inserted into the retainer insertion space 218 from the insertion space aperture 218A of the housing body 21 on the downward direction Z2 side toward the upward direction Z1. In a state where the retainer 3 is inserted into the retainer insertion space 218, the locking projection 32A is engaged with the temporary locking projection 21C or the final locking projection 21D, and the position of the retainer 3 with respect to the housing body 21 in a state where the locking projection 32A is engaged with the temporary locking projection 21C is defined as a temporary locking position, and the position of the retainer 3 with respect to the housing body 21 in a state where the locking projection 32A is engaged with the final locking projection 21D is defined as a final locking position.

When the retainer 3 is at a temporary locking position, the locking projection 32A of the retainer 3 is engaged with the temporary locking projection 21C of the housing body 21, and the retainer lower surface 3A of the retainer 3 projects in the downward direction Z2 from the lower surface 21A of the housing body 21. In addition, the terminal insertion hole 31 of the retainer 3 corresponds to and is communicated with the terminal housing chamber 211 of the housing body 21 in the front-rear direction X. In other words, at the temporary locking position, in a process where the terminal 4 is inserted into the terminal housing chamber 211, the terminal 4 can pass through the terminal insertion hole 31. This state is a temporary locking state, and the locking projection 32A of the retainer 3 and the temporary locking projection 21C of the housing body 21 form a temporary locking unit.

When the retainer 3 is at a final locking position, the locking projection 32A of the retainer 3 is engaged with the final locking projection 21D of the housing body 21, and the retainer lower surface 3A of the retainer 3 is substantially flat with the lower surface 21A of the housing body 21 in the height direction Z as illustrated in FIG. 1. In addition, the terminal insertion hole 31 of the retainer 3 is shifted to the upward direction Z1 side with respect to the terminal housing chamber 211 of the housing body 21. This shift causes a second locking unit 36A of the retainer 3, which will be described later, to be engaged with the second locked unit 462B of the terminal 4 (refer to FIG. 1). This state is a final locking state, and the locking projection 32A of the retainer 3 and the final locking projection 21D of the housing body 21 form a final locking unit.

The retainer 3 includes the second locking unit 36A, a groove unit 38, and a projection strip unit 37.

The second locking unit 36A is a surface of the lower plate 34 on the front direction X1 side of the retainer 3, and is the same face as a surface of the projection strip unit 37 on the front direction X1 side.

The groove unit 38 is adjacent to the projection strip unit 37 on the left direction Y1 side, and is adjacent to the side plate 35 or the outer side plate 32 on the right direction Y2 side. The groove unit 38 is formed along the front-rear direction X on the upward direction Z1 of the lower plate 34. In a process where the terminal 4 in a temporary locking state is inserted into the terminal housing chamber 211, the groove unit 38 allows passage of the stabilizer 43A.

An end of the projection strip unit 37 on the left direction Y1 is connected to the side plate 35 or the outer side plate 32. The projection strip unit 37 projects in the upward direction Z1 from a surface of the lower plate 34 on the upward direction Z1 side. A surface of the projection strip unit 37 on the front direction X1 side is the same face as a surface of the lower plate 34 on the front direction X1 side. In addition, a surface of the projection strip unit 37 on the rear direction X2 side is an inclined surface and does not reach a surface of the lower plate 34 on the rear direction X2 side.

The dimension of the projection strip unit 37 is set smaller than that of the notch 463 of the terminal 4 in the front-rear direction X. The notch 463 of the ceiling plate 46 is formed from a surface of the first side plate 43 on the left direction Y1 side to a surface of the second side plate 44 on the right direction Y2 side in the width direction Y. In other words, when the projection strip unit 37 is projected on the notch 463 in the height direction Z, the dimension of the projection strip unit 37 is set to the dimension that allows the projection strip unit 37 to enter the notch 463. Assuming that the inner plate 45 does not include the projection part 45A, in a mid-insertion state where the terminal 4 is in the middle of being inserted into the terminal housing chamber 211, if the retainer 3 that is in a temporary locking state is inserted toward the upward direction Z1, the projection strip unit 37 abuts on the inner plate 45. In this manner, the retainer lower surface 3A projects by a predetermined projection amount "T" from the lower surface 21A (refer to FIGS. 6 and 7). By contrast, as in the present embodiment, when the inner plate 45 includes the projection part 45A, in a mid-insertion state, if the retainer 3 is inserted toward the upward direction Z1, the projection strip unit 37 of the retainer 3 abuts on the projection part 45A of the inner plate 45 and the retainer lower surface 3A projects in the downward direction Z2 by a projection amount of the projection part "ΔT" that is added to the predetermined projection amount "T" from the lower surface 21A.

The following describes assembly of the connector 1. The retainer 3 is preliminarily inserted from the insertion space aperture 218A of the housing body 21 into the retainer insertion space 218, and is disposed at a temporary locking position with respect to the housing body 21 and is in a temporary locking state. In a temporary locking state, the terminal 4 connected to the electric wire W is inserted from the aperture 216 of the housing body 21 into the terminal housing chambers 211. When the terminal 4 is housed at a predetermined position in the terminal housing chambers 211 and is completely inserted, the terminal 4 is engaged with the lance 217. Subsequently, the retainer 3 disposed at a temporary locking position is inserted down to a final locking position. When the retainer 3 is disposed at a final locking position and is in a final locking state, the second locking unit 36A of the retainer 3 is engaged with the second locked unit 462B of the terminal 4. As described above, the assembly of the connector 1 is completed.

In the present embodiment, as illustrated in FIG. 5, the ceiling plate 46 and the inner plate 45 in the terminal 4 are superimposed and the projection part 45A of the inner plate 45 is engaged with the projection part engagement surface 462A of the rear ceiling plate 462 in the front-rear direction X. In the middle of handling the terminal 4 connected to the electric wire W in transportation and the like, even when a tensile force toward the rear direction X2 is applied to the electric wire W in a state where the rear direction X2 side of the rear ceiling plate 462 in the terminal 4 is caught in the periphery, the rear ceiling plate 462 is prevented from relatively moving with the inner plate 45 in the front-rear direction X. Thus, deformation of the box 41 due to relative movement between the rear ceiling plate 462 and the inner plate 45 can be prevented, thereby improving strength of the terminal 4.

In the present embodiment, in a mid-insertion state, if the retainer 3 that is in a temporary locking state is inserted toward the upward direction Z1, the projection strip unit 37 of the retainer 3 abuts on the projection part 45A of the inner plate 45 and the retainer lower surface 3A projects in the downward direction Z2 by an increased projection amount of the projection part "ΔT" that is added to the predetermined projection amount "T" from the lower surface 21A. As compared with a case where the retainer 3 is at the final locking position and the retainer lower surface 3A is substantially flat with the lower surface 21A in the height direction Z, in a mid-insertion state, while the projection strip unit 37 of the retainer 3 abuts on the projection part 45A of the inner plate 45, a projection amount of the retainer lower surface 3A in the downward direction Z2 with respect to the lower surface 21A is increased. Thus, a worker can easily recognize that the terminal 4 is in a mid-insertion state based on visual perception or tactile perception. In this manner, mid-insertion of the terminal 4 that is inserted into the housing 2 can be surely detected and detecting accuracy can be enhanced by using a projection part that improves strength of the terminal 4.

In the present embodiment, the locking projection 32A of the retainer 3 and the temporary locking projection 21C of the housing body 21 form a temporary locking unit, and the locking projection 32A of the retainer 3 and the final locking projection 21D of the housing body 21 form a final locking unit. The retainer 3 is preliminarily inserted into the retainer insertion space 218 from the insertion space aperture 218A in the housing body 21 on the downward direction Z2 side toward the upward direction Z1, and the retainer 3 is in a temporary locking state. In a temporary locking state of the retainer 3, the terminal insertion hole 31 of the retainer 3 corresponds to and is communicated with the terminal housing chamber 211 of the housing body 21 in the front-rear direction X. In a process where the terminal 4 is inserted into the terminal housing chamber 211, the terminal 4 can pass through the terminal insertion hole 31. Thus, in a process where the terminal 4 is inserted while the retainer 3 is in a temporary locking state with respect to and is integrated with the housing 2, the housing 2 can be supplied. The housing 2 and the retainer 3 are integrated with each other so as to facilitate management.

In the embodiment described above, the connector is described as the male connector 1 that houses the male terminal 4 including the tab 48, but a female connector that houses a female terminal may be used.

In the embodiment described above, in a temporary locking state, the temporary locking projection 21C of the housing body 21 and the locking projection 32A of the retainer 3 are engaged with each other and, in a final locking state, the final locking projection 21D of the housing body 21 is engaged with the locking projection 32A of the retainer 3. However, the temporary locking projection 21C of the housing body 21 may be eliminated, and a temporary locking state may be eliminated. In this case, if the terminal insertion hole 31 of the retainer 3 is formed in a complete cylindrical shape, the retainer 3 is not assembled to the housing body 21 and the terminal insertion hole 31 needs to be formed in a semi-cylindrical shape.

In the embodiment described above, the notch 463 of the ceiling plate 46 in the terminal 4 is formed from a surface of the first side plate 43 on the left direction Y1 side to a surface of the second side plate 44 on the right direction Y2 side in the width direction Y. However, the notch 463 of the ceiling plate 46 may be a hole formed in a width dimension of the ceiling plate 46 in the width direction Y. In this case, a width dimension of the projection strip unit 37 needs to be made smaller than that of the hole in the ceiling plate 46.

The terminal and the connector according to the present embodiment can improve terminal strength.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal comprising:

an electric wire; and a terminal being connected to the electric wire, the terminal including a box, and an electric wire connecting unit, wherein a cross section of the box in a direction perpendicular to a front-rear direction has a rectangular shape, the box includes a bottom plate, a first side plate, a second side plate, an inner plate, and a ceiling plate, the first side plate and the second side plate face each other in a width direction, the bottom plate and the inner plate face each other in a height direction, the ceiling plate is superimposed on the inner plate on a side of the inner plate opposite to a side thereof facing the bottom plate, has a notch formed at the midpoint in the front-rear direction, and includes a front ceiling plate on a front direction side and a rear ceiling plate on a rear direction side, the front ceiling plate includes a first locked unit on the rear direction side, the rear ceiling plate includes a projection part engagement surface on the front direction side and a second locked unit on the rear direction side, the inner plate includes a projection part that projects on the ceiling plate side, and the projection part is engaged with the projection part engagement surface in the front-rear direction.

2. A connector comprising:

the terminal according to claim 1;

a housing; and a retainer, wherein the housing includes a housing body, the housing body has a terminal housing chamber formed therein, the terminal housing chamber passing through the housing body in a front-rear direction, the housing body has an aperture on a rear direction side of the terminal housing chamber, a cross section of the terminal housing chamber in a direction perpendicular to the front-rear direction has a rectangular shape, the housing body includes a lance that is elastically deformable, the lance including a first locking unit projecting in the terminal housing chamber, a body lower surface that is a surface of the housing body on a downward direction side, a retainer insertion space that is, in the front-rear direction, disposed on the rear direction side of the lance so as to separate the terminal housing chamber, and an insertion space aperture that is formed on the downward direction side of the retainer insertion space, the terminal is inserted from the aperture of the housing body on the rear direction side into the terminal housing chamber, the retainer is inserted into the retainer insertion space from the insertion space aperture of the housing body on the downward direction side toward an upward direction, the retainer includes a projection strip unit, a second locking unit, and a retainer lower surface that is a surface of the retainer on the downward direction side, the projection strip unit projects on the upward direction side and has a dimension that allows the projection strip unit to enter the notch when seen in a height direction, and in a mid-insertion state where the terminal is middle of being inserted into the terminal housing chamber, when the retainer is inserted into the retainer insertion space toward the upward direction, the projection strip unit abuts on the projection part, and the retainer lower surface projects in the downward direction by an increased projection amount of the projection part with respect to a predetermined projection amount from the body lower surface of the housing body.

3. The connector according to claim 2, wherein the housing body and the retainer include a temporary locking unit and a final locking unit.

* * * * *